US010896769B2

(12) United States Patent
Moricca et al.

(10) Patent No.: US 10,896,769 B2
(45) Date of Patent: Jan. 19, 2021

(54) ACTIVE FURNACE ISOLATION CHAMBER

(71) Applicants: Salvatore Moricca, Woonona (AU); Rajendra Persaud, Westerville, OH (US)

(72) Inventors: Salvatore Moricca, Woonona (AU); Rajendra Persaud, Westerville, OH (US)

(73) Assignee: American Isostatic Presses, Inc., Columbus, OH (US)

( * ) Notice: Subject to any disclaimer, the term of this patent is extended or adjusted under 35 U.S.C. 154(b) by 523 days.

(21) Appl. No.: 15/644,034

(22) Filed: Jul. 7, 2017

(65) Prior Publication Data

US 2018/0012671 A1 Jan. 11, 2018

Related U.S. Application Data

(60) Provisional application No. 62/359,746, filed on Jul. 8, 2016.

(51) Int. Cl.

| | |
|---|---|
| ***G21F 9/00*** | (2006.01) |
| ***B22F 3/15*** | (2006.01) |
| ***G21F 9/30*** | (2006.01) |
| ***G21F 9/36*** | (2006.01) |

(52) U.S. Cl.

CPC ..... *G21F 9/008* (2013.01); *B22F 3/15* (2013.01); *G21F 9/301* (2013.01); *G21F 9/36* (2013.01); *B22F 2003/153* (2013.01); *B22F 2998/10* (2013.01); *B22F 2999/00* (2013.01)

(58) Field of Classification Search

CPC . G21F 9/00; G21F 9/008; G21F 9/301; G21F 9/36

USPC ..... 588/2

See application file for complete search history.

(56) References Cited

U.S. PATENT DOCUMENTS 8,207,391 B2 * 6/2012 Yamada ..... B01J 20/0222 502/68

2013/0109903 A1 5/2013 Persaud

FOREIGN PATENT DOCUMENTS

| | | | |
|---|---|---|---|
| DE | 10 2008 058329 | A1 | 5/2010 |
| DE | 10 2008 058330 | A1 | 5/2010 |
| EP | 0 145 417 | A2 | 6/1985 |

OTHER PUBLICATIONS

International Search Report for PCT/US2017/041080.

* cited by examiner

*Primary Examiner* — Edward M Johnson

(74) *Attorney, Agent, or Firm* — Finnegan, Henderson, Farabow, Garrett & Dunner, LLP

(57) ABSTRACT

A furnace isolation chamber for containing a component to be Hot Isostatically Pressed is disclosed. The disclosed furnace includes inherent passive features to assist in the containment of released toxic gases via a thermal gradient within the chamber. The chamber comprises longitudinally cylindrical sidewalls; a top end extending between and permanently connected to the sidewalls, thereby closing one end of the chamber; and a movable bottom end, which is opposite the top end and forms a base end of the chamber. The movable bottom end is adapted to receive the component, and comprises a mechanism for raising and lowering the component into the high temperature zone of the furnace in the HIP system. The isolation chamber forms an integral part of the HIP system with the base end of the chamber comprising a cool zone as a result of being located outside of the high temperature zone of the furnace.

24 Claims, 14 Drawing Sheets

ACTIVE FURNACE ISOLATION CHAMBER

This application claims priority to U.S. Provisional Application No. 62/359,746, filed on Jul. 8, 2016, which is incorporated herein by reference in its entirety.

There is disclosed a physical isolation chamber that forms an integral part of a Hot Isostatic Press ("HIP"), which is located between a component to be Hot Isostatically Pressed and a furnace. There is also disclosed a method of physically containing and preventing migration of any hazardous/radioactive particulate, powder, and/or gas that may escape from a HIP can to the furnace or HIP vessel.

In a HIP process a material to be consolidated is exposed to both elevated temperature and isostatic gas pressure in a high pressure containment vessel. The pressurizing gas is an inert gas, such as nitrogen or argon, so that the material does not chemically react. The chamber is heated, causing the pressure inside the vessel to increase, such that pressure is applied to the material in an isostatic manner. There remains a need to avoid contaminantion of HIP systems from potentially harmful elements found in the materials undergoing consolidation.

One apparatus for containing radioactive and/or toxic substances to be subjected to high pressures and/or temperatures is referred to as an Active Containment Over Pack" system ("ACOP"). The ACOP system is not an integral part of an HIP system. Rather, it is a containment device which is a can inside of a can design that must be placed into a furnace chamber for each use. In addition to the potential of damaging the furnace due to alignment issues and thermal expansion differences as compared to the furnace materials, the ACOP system must be placed in a high temperature region of the furnace for it to operate, which leads to operation deficiencies. For example, as the entire ACOP system is located in the high temperature region of a HIP furnace, there are technical problems associated with thermal expansion and creep distortion of a seal area.

In addition, filters of an ACOP system are also necessarily located in the high temperature region of a HIP furnace, which can cause problems in containing radioactive and/or toxic materials. This is because the continual use of these filters at high temperature causes the filter pore size to change. Therefore, the ability to maintain consistent performance over time is compromised. In addition, the filters have low strength at high temperatures and when fast decompression of the HIP occurs the filters can rupture and breach containment of which they were designed to maintain.

Loss or reduction of gas pressure at high temperature can also cause a porous metal filter to sinter and close off through-holes; this could cause a potential problem as gas pressure will be trapped in the ACOP chamber. The pressure inside the ACOP may lead to a pressurized container that presents a hazard for an operator trying to unload the HIP can/component. The resultant problems associated with the combination of locating the seals and filters in the high temperature region of the furnace increases the possibility that that the contents of the ACOP system can contaminant the HIP system.

For at least the foregoing reasons, ACOP systems typically require a high degree of maintenance/replacement. Thus, there is a possibility that during a HIP cycle, through either thermal gradients or pressure differential across the filters, a break could form in the sealing area. Furthermore, ACOP systems are made of metal, and at HIP process temperatures, the mechanical strength of the ACOP is low.

As a result, the thickness of the ACOP may be increased in order to provide some strength, which makes the unit heavy.

In addition, depending on the closure type, the ACOP takes up space in the HIP system. For example, in a bolted flange design the flange occupies space that reduces the working size of the ACOP cavity; meaning either a smaller part or a larger HIP needs to be used to maintain the cavity size. The end closure of an ACOP system may be done by a flange/lid with a series of spaced apart and threaded bolts. Alternatively, the flange/lid can be attached by screwing it on as a lid, similar to a jar lid, or other mechanical clamps or locks that effectively sandwich a sealing material/gasket to create a seal. The metal mating surfaces, whether threads or flat faces, have intimate contact at high temperatures and pressures. This may cause them to diffusion bond or stick/weld, making them difficult to get apart and, consequently, difficult to remove the component. Although coatings can be used to prevent bonding, coatings have limited life span and often need to be re-applied regularly. Moreover, applying coatings in a radioactive environment remotely is difficult and adds complexity to the HIP process.

The disclosed Active Furnace Isolation Chamber ("AFIC") for containing a component to be Hot Isostatically Pressed ("HIPed") addresses one or more of the problems set forth above and/or other problems of the prior art.

SUMMARY

In one aspect, the present disclosure is directed to a furnace isolation chamber for containing a component to be HIPed. In an embodiment, the chamber comprises: longitudinally cylindrical sidewalls; a top end extending between and permanently connected to the sidewalls, thereby closing one end of the chamber; and a movable bottom end, which is opposite the top end and forms a base end of the chamber. The movable bottom end is adapted to receive the component, and comprises a mechanism for raising and lowering the component from a cold temperature zone outside the furnace in a HIP system to a high temperature zone of the furnace in the HIP system. Unlike an ACOP device typically used in HIP systems, the described isolation chamber forms an integral part of the HIP system with the base end of the chamber being located outside of the high temperature zone of the furnace. The disclosed inventive isolation chamber allows for integral components to be located outside the high temperature zones, such as critical seals and filters, which may be compromised by the extreme pressures and temperatures of the HIP process.

There is also disclosed a method of HIPing a component using the furnace isolation chamber described herein. In a non-limiting embodiment, the method comprises consolidating a calcined material comprising radioactive material, the method comprising: mixing a radionuclide containing calcine with at least one additive to form a pre-HIP powder; loading the pre-HIP powder into a can; sealing the can; loading the sealed can into the furnace isolation chamber as described herein, closing said HIP vessel; and hot-isostatic pressing the sealed can within the furnace isolation chamber of the HIP vessel.

DETAILED DESCRIPTION OF THE DRAWINGS

FIG. 12A is an exploded view of various aspects that correspond to the embodiment of FIG. 12B.

It is to be understood that both the foregoing general description and the following detailed description are exemplary and explanatory only and are not restrictive of the invention, as claimed.

DETAILED DESCRIPTION

In one embodiment, the Active Furnace Isolation Chamber described herein overcomes problems and limitations of currently used systems that are meant to protect a furnace from radioactive/hazardous material. The described Active Furnace Isolation Chamber overcomes limitations of currently used systems in at least the following ways:

- There are no flanges or seal faces in the hot zone, thereby allowing the use of high strength materials;
- High strength materials allow thinner sections to be used;
- The integrated design guarantees alignment, thereby allowing for remote loading/unloading;
- As there is no need for sealing flanges or special opening end closures there is no wasted space in the furnace hot zone;
- Sealing is in the lower temperature zone, thereby overcoming diffusion bonding issues between the sealing;
- Filters in the hot zone area are optional and not essential, therefore even if rapid depressurization occurs, the pressure has a path way through the lower temperature filter thereby reducing pressure differential across the filters in the hot zone, thus preventing filter rupture; and
- When a lower filter is used, it will not close off and therefore a path for gas to equalize with the vessel pressure is provided for preventing pressurized chamber scenarios.

Figures 1A, 1B:
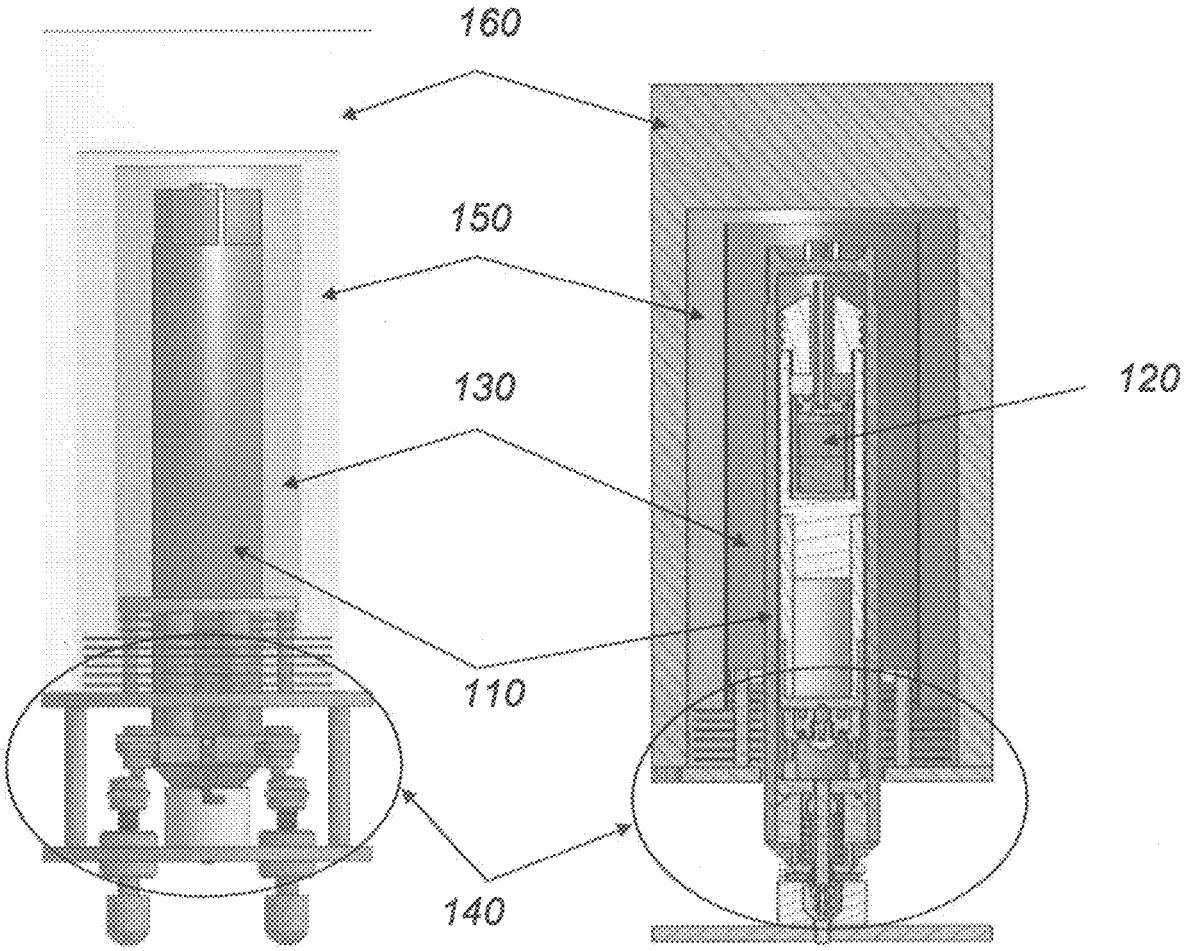
FIGS. 1A and 1B are section views of a furnace isolation chamber located in a Hot Isostatic Press according to an embodiment of the present disclosure.

With reference to FIGS. 1A and 1B, the Active Furnace Isolation Chamber according to the present disclosure is an integral part of an HIP furnace design. As used herein, forming an "integral part of the HIP system" is intended to mean that the AFIC is not loaded and unloaded for each process, as required for an ACOP system, but which is a permanent component of the HIP furnace design. In FIG. 1, a chamber 110, within which the part to be HIPed 120 is contained. The AFIC contains a high temperature chamber 110, at least part of which is contained within the hot zone of the HIP furnace 130. In one embodiment, shown in FIGS. 1A and 1B, the bottom end of the AFIC is located outside the furnace, which forms a cool zone 140. According to the exemplary embodiment, the complete assembly further contains one or more insulation and/or thermal barrier layers 150, 160.

Figure 2:
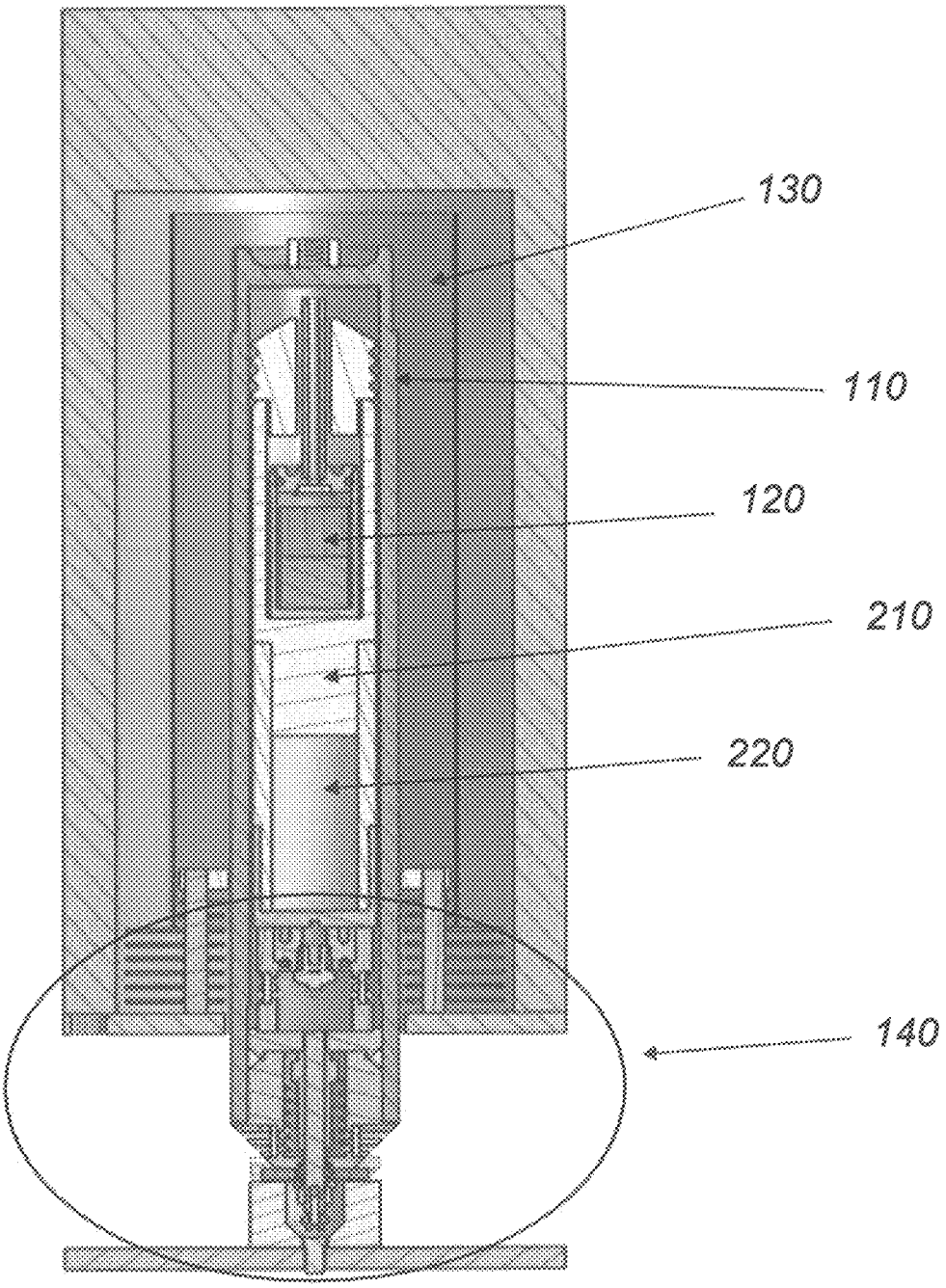
FIG. 2 is an expanded view of the furnace isolation chamber according to the embodiment shown in FIG. 1B.

FIG. 2 shows an expanded view of the furnace isolation chamber according to the embodiment of the present disclosure shown in FIG. 1B. In various embodiments, the chamber 110 can be made of a wide range of high temperature high strength materials. A non-limiting list of such materials includes tungsten (W), molybdenum (Mo), as well as super alloys and ceramics.

With further reference to FIG. 2, there is shown an area 210 integral to the disclosed AFIC, which is designed to contain particulate release and melt that may escape from a HIP can. In addition, there are a number of advantages of the disclosed design of the furnace and AFIC, particularly with the bottom end of the AFIC being located outside the furnace, which forms a cool zone 140. As a result of this design, any escaped volatile gas is contained by condensation in the cool zone 140 before reaching filters located at the bottom of the chamber. In the exemplary embodiment of FIG. 2, to ensure a thermal gradient, it is possible to include an insulator 220 between the hot zone 130 and the cool zone 140.

In one embodiment, the cool zone 140 contains at least one device for measuring the presence of radioactivity from a radioactive containing gas that condenses on the walls of the chamber within the cool zone 140. By having such a measuring device, it is possible to immediately detect relatively small breaches in the HIP can and/or the AFIC before a catastrophic unwanted escape of radioactive gas.

The furnace design according to the present disclosure may also ensure the working volume is maximized. In particular, as the bottom end of the AFIC is located outside the hot zone 130 of the furnace, which forms the cool zone 140, there is no loss of volume due to flanges or seals being in the hot zone 130.

Figure 3:
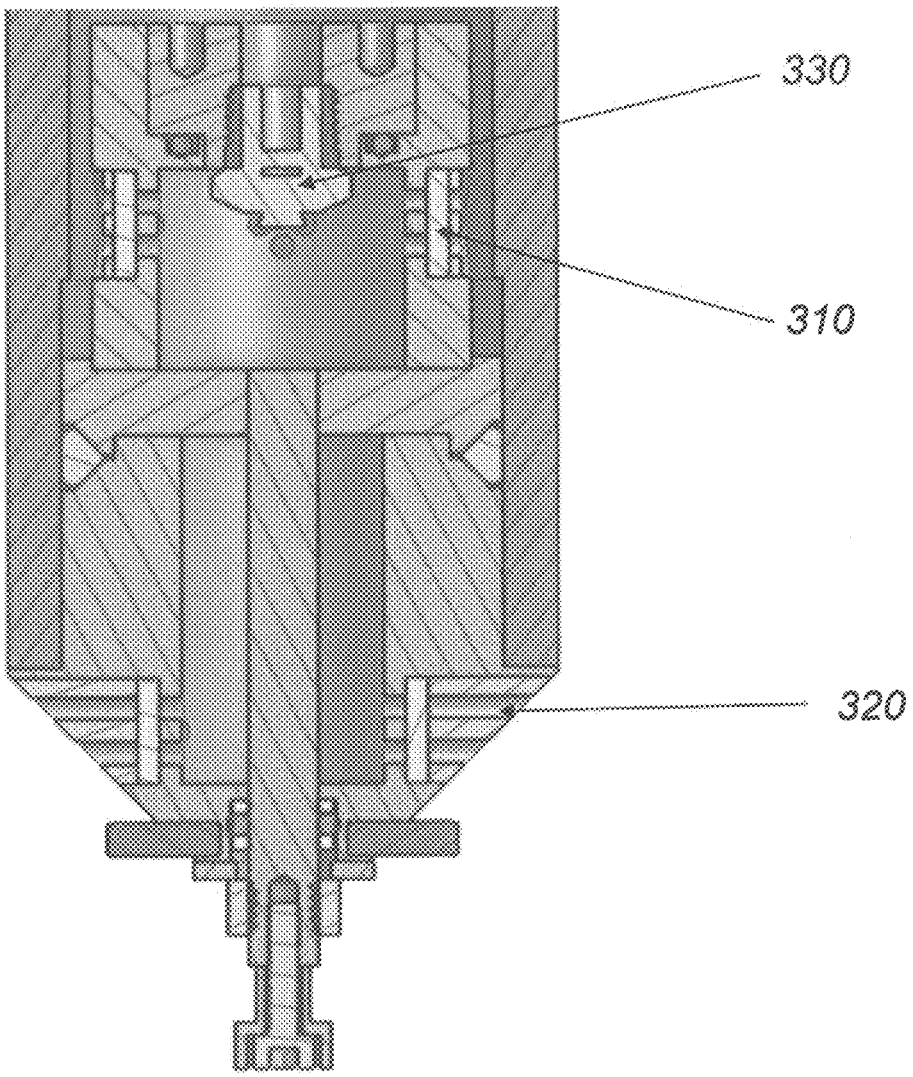
FIG. 3 is an expanded view of the bottom, end cool zone of the furnace isolation chamber shown in circle in FIG. 2.
Figure 4:
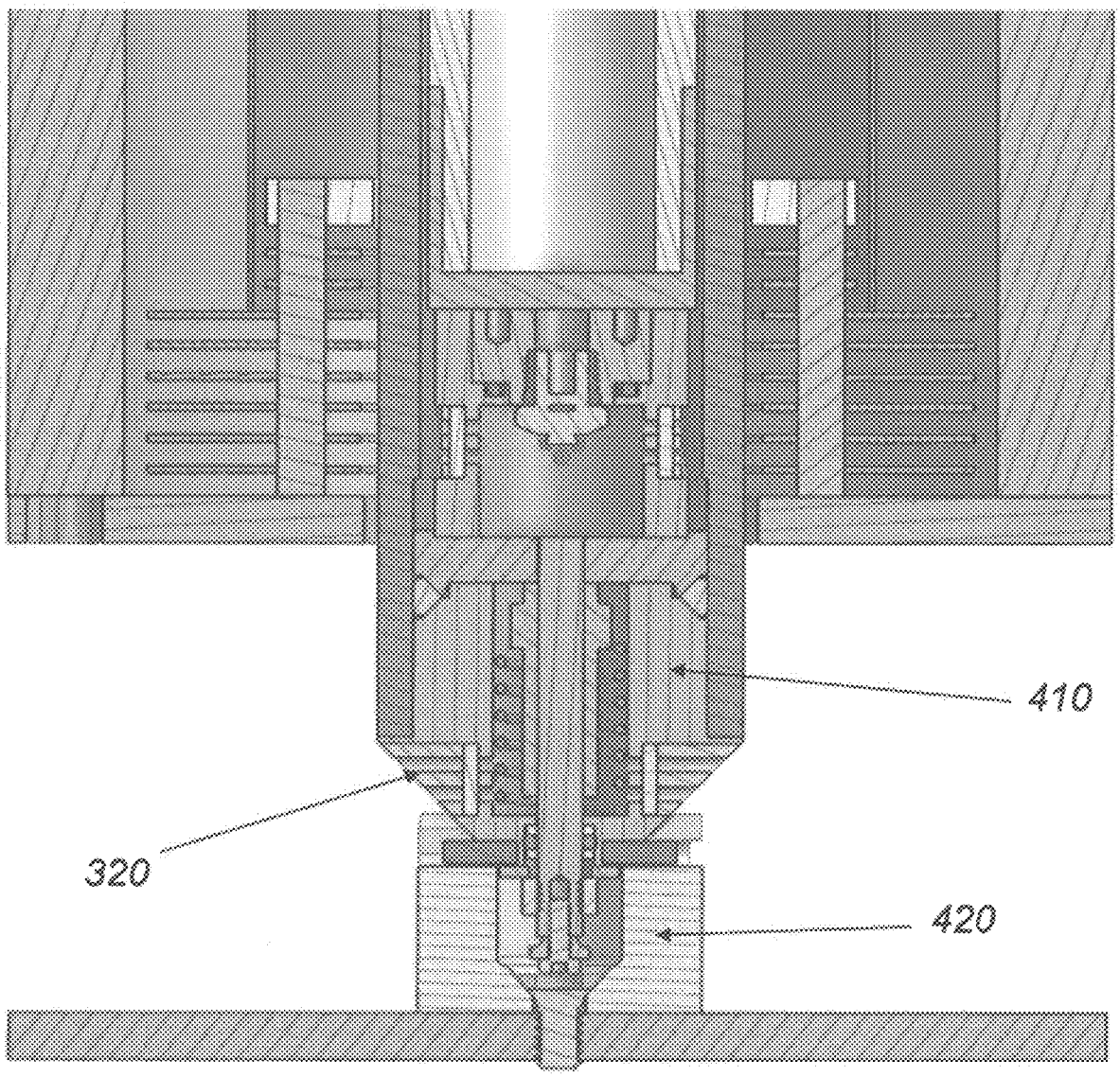
FIG. 4 is an expanded view of an additional inventive embodiment of the bottom, end cool zone of the furnace isolation chamber shown in circle in FIG. 2.

In an embodiment shown in FIG. 3, the AFIC may contain porous metal or ceramic filters. In the exemplary embodiment, the filters are shown as primary filters 310, in the hot zone 130, as well as secondary filters 320 in the cool zone 140. When such primary and/or secondary filters are present, the pressurizing gas associated with the HIP system is able to communicate with and act on the part through filter material. As shown, the filters 310, 320 can be located either solely in the base of the chamber outside of the furnace zone 320 and/or may be incorporated in the walls and top of isolation chamber 310. In the exemplary embodiment, the AFIC contains an over-pressure relief valve 330, which may control or limit the pressure in an HIP system that may build up during HIPing. Relief valve 330 may be designed or set to open at a predetermined pressure in order to protect the AFIC and other equipment from being subjected to pressures that exceed their design limits FIG. 4 is an expanded view of an additional inventive embodiment of the bottom, end cool zone of the furnace isolation chamber shown in circle in FIG. 2. This embodiment also shows sealing plug 410 and a located seat 420, configured to ensure proper alignment of the AFIC and facilitate robotic or remote handling of the AFIC system.

Figure 5A:
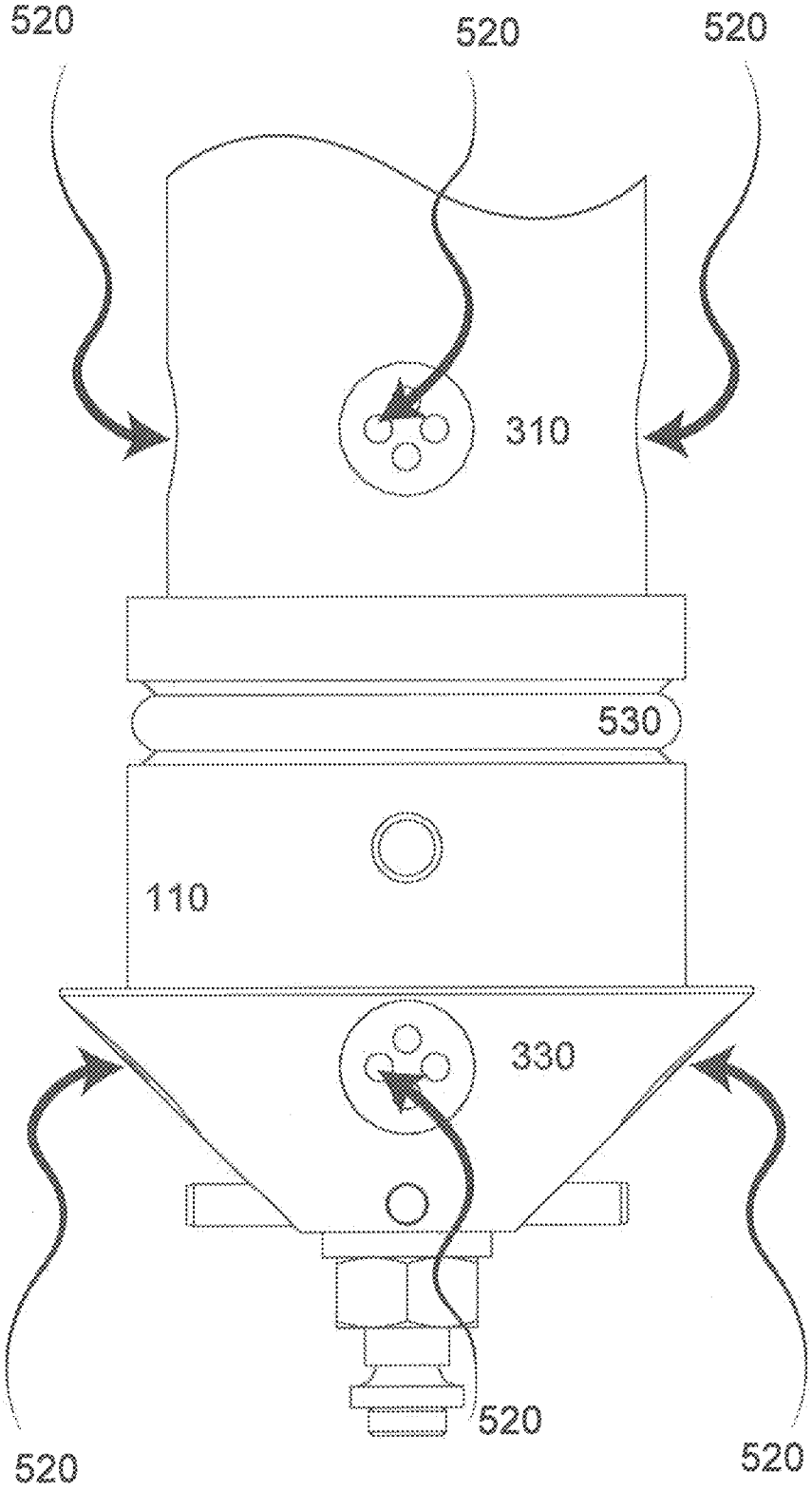
FIGS. 5A and 5B are section views of filters and gas flow paths for the furnace isolation chamber according to an embodiment of the present disclosure.
Figure 5B:
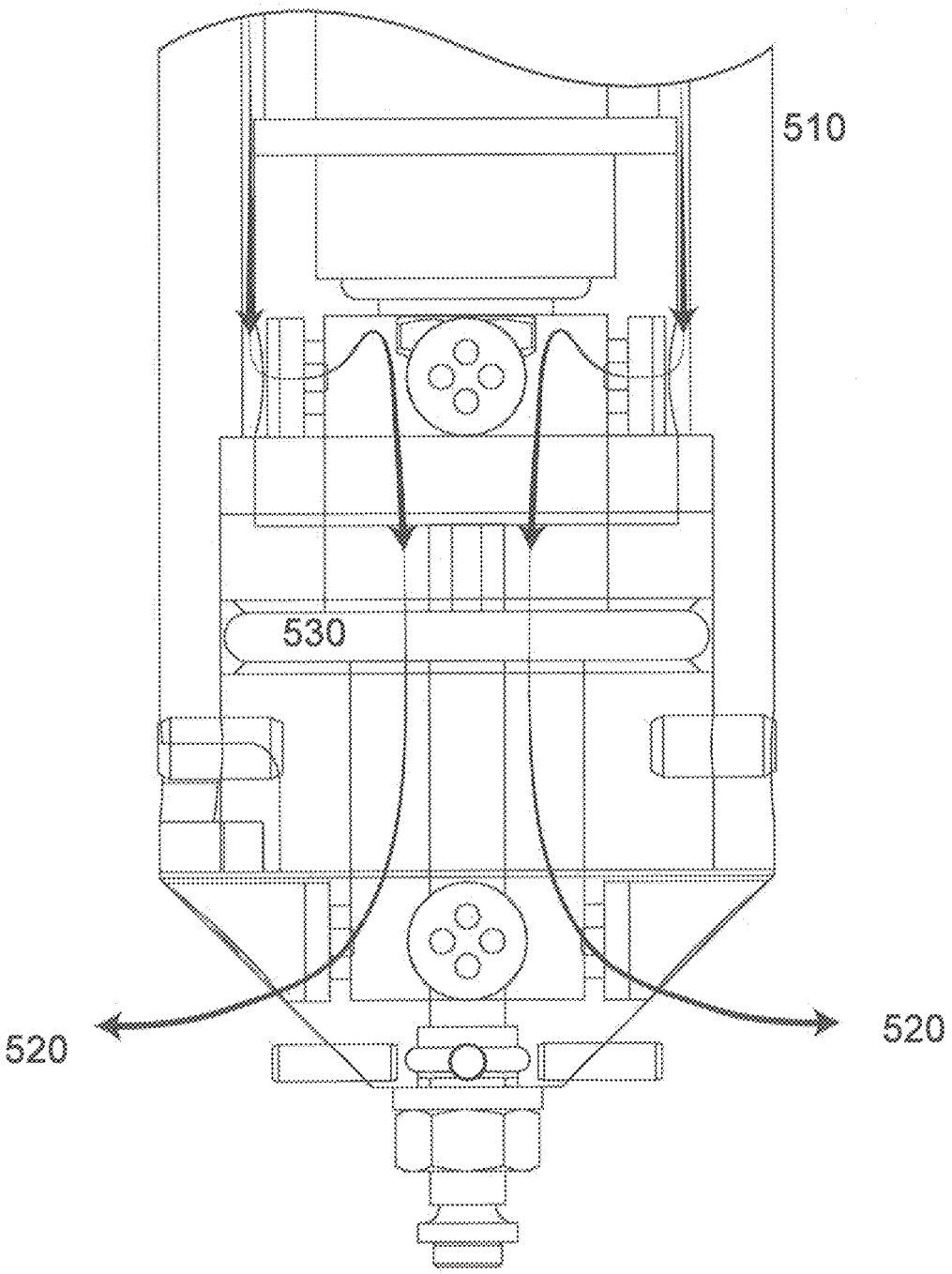

As shown, the AFIC described herein may contain filters in the hot zone 130 (primary filters 310) and in the cold zone 140 (secondary filters 320) of a reactor. The exemplary embodiment of FIGS. 5A and 5B show expanded views of AFIC filters and seals. In particular, FIG. 5A is a perspective view of a sealing plug and FIG. 5B is a perspective of the sealing plug after being coupled with chamber 110. FIGS. 5A and 5B show the location of primary filters 310 (sintered metal) and secondary filters 330 (sintered metal). The exemplary embodiment further shows an O-ring 530 that seals against the inside of chamber wall 510. Exemplary gas flow paths 520 through the AFIC are shown.

At least one benefit of locating primary filters 520 in the hot zone is that heat is able to transfer through them via convective flow of gas. Without these filters, heat transfer will be via radiant and conductive heat transfer. A potential disadvantage of having the filters in the hot zone, of which the present disclosure overcomes, is the loss of mechanical strength at high temperature and the changing in filter pore size over time at varying temperatures. However, when filters 520 primary function is to prevent particulates from escaping the chamber, it may inadvertently compromise the intended function of the chamber. Ceramic-based filters can, in part, overcome this problem in many respects. An advantage of alternatively and/or additionally having filters 330 in the lower temperature zone 140 of the HIP allows the mechanical strength and the filter pore size to be maintained throughout use. Additional advantages may be realized by the disclosed embodiments when the chamber 110 is made of high temperature high strength materials such as: molybdenum, tungsten, carbon-carbon materials, with no separable parts in the hot zone.

Figure 6:
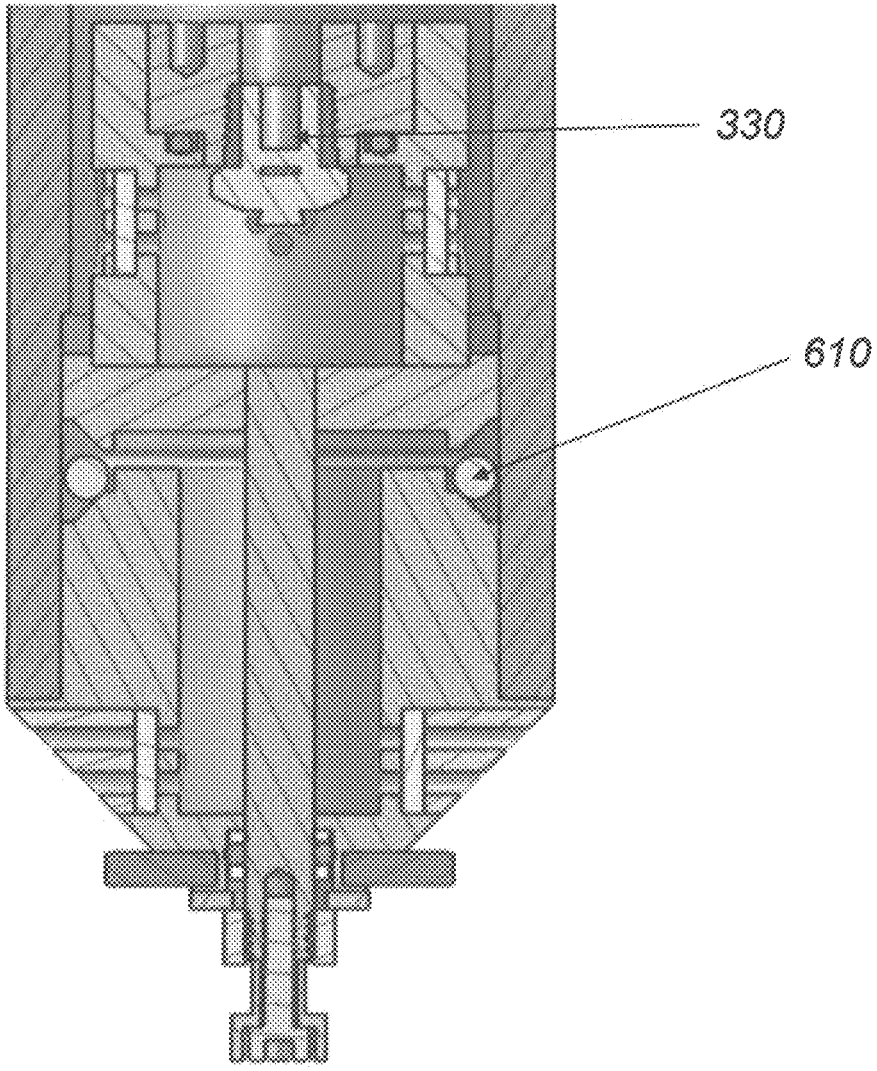
FIG. 6 is an expanded view of the bottom, end cool zone of the furnace isolation chamber shown in circle in FIG. 2 with O-ring uncompressed.
Figure 7:
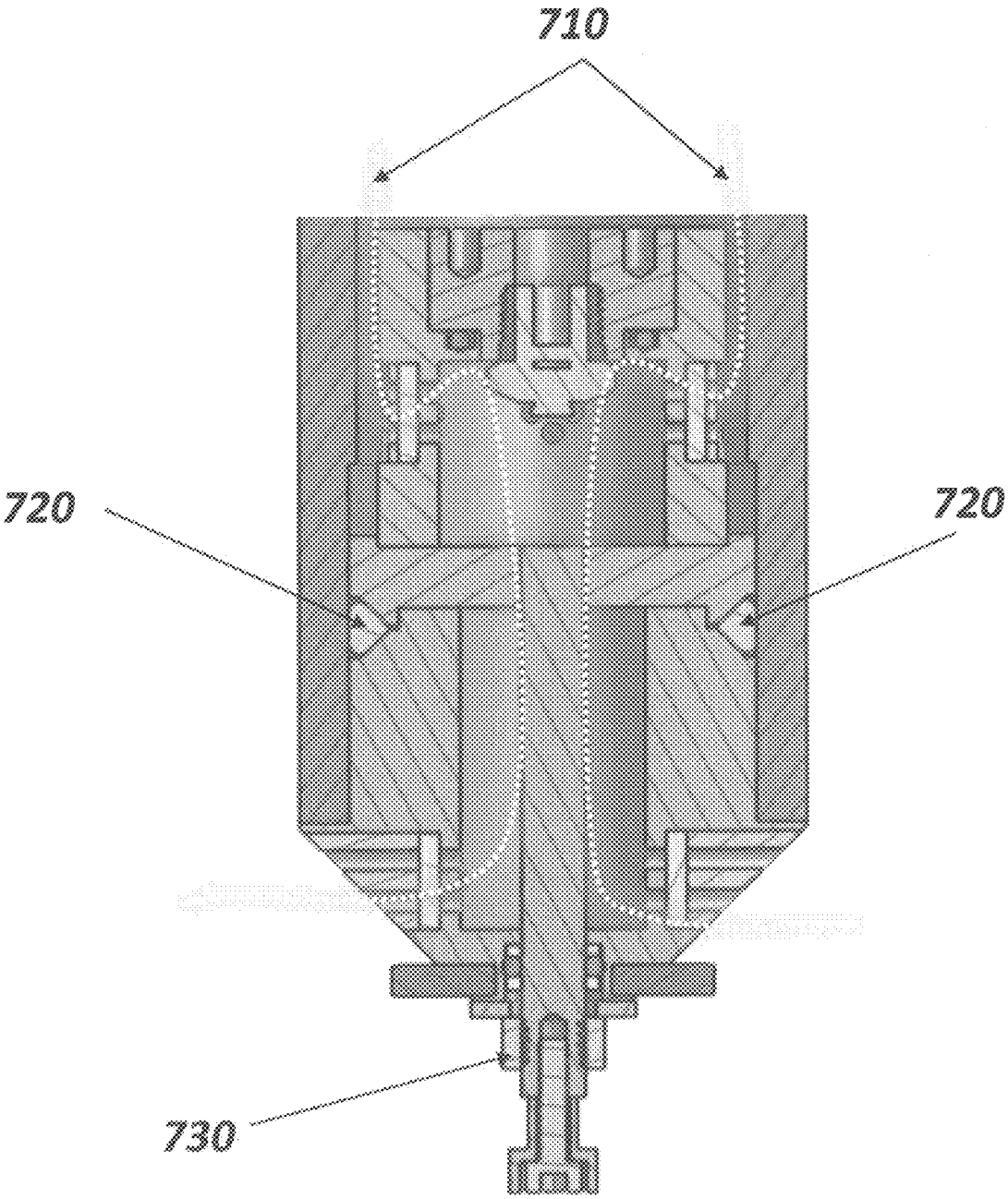
FIG. 7 is an expanded view of the bottom, end cool zone of the furnace isolation chamber shown in circle in FIG. 2 with O-ring compressed.

In the exemplary embodiment according to FIG. 6 an expanded view of the bottom, end cool zone of the furnace isolation chamber with particular reference of uncompressed O-ring 610 being shown. FIG. 7 illustrates the same embodiment of FIG. 6 but having compressed O-ring 720. The O-ring 720 may be compressed by tightening of compression nut 730. In some embodiments, multiple O-rings 720 may be used (not shown). In other embodiments still, a gasket or other similarly situated material configured to provide a sealing surface upon compression may be used. FIG. 7 further shows gas flow paths 710 through the bottom, end cool zone of the furnace isolation chamber.

Figure 8:
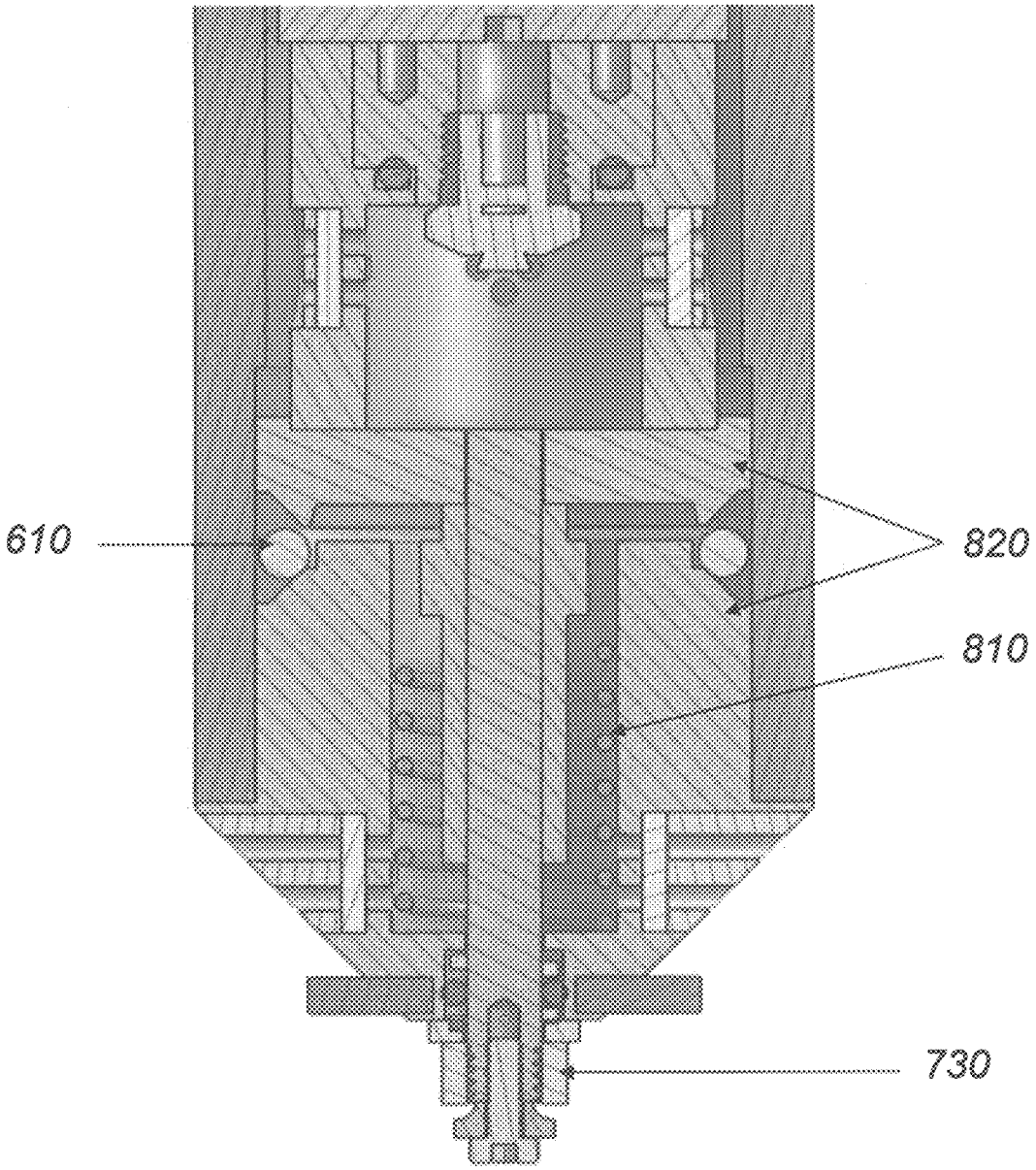
FIG. 8 is an expanded view of an additional inventive embodiment of the bottom, end cool zone of the furnace isolation chamber shown in circle in FIG. 2 with O-ring uncompressed.

As shown in FIG. 8, which is an expanded view of an additional inventive embodiment of the bottom, end cool zone of the furnace isolation chamber shown in circle in FIG. 6. In the exemplary embodiment of FIG. 8, there is shown a spring-loaded mechanism that allows the O-ring 610 to remain uncompressed and the AFIC to remain in an open position. As shown in FIG. 8, compression nut 730 is not tightened. As a result, the uncompressed spring 810 allows plates 820 to remain separated by applying a biasing force, and thus O-Ring 610 remain in an uncompressed state.

Figure 9:
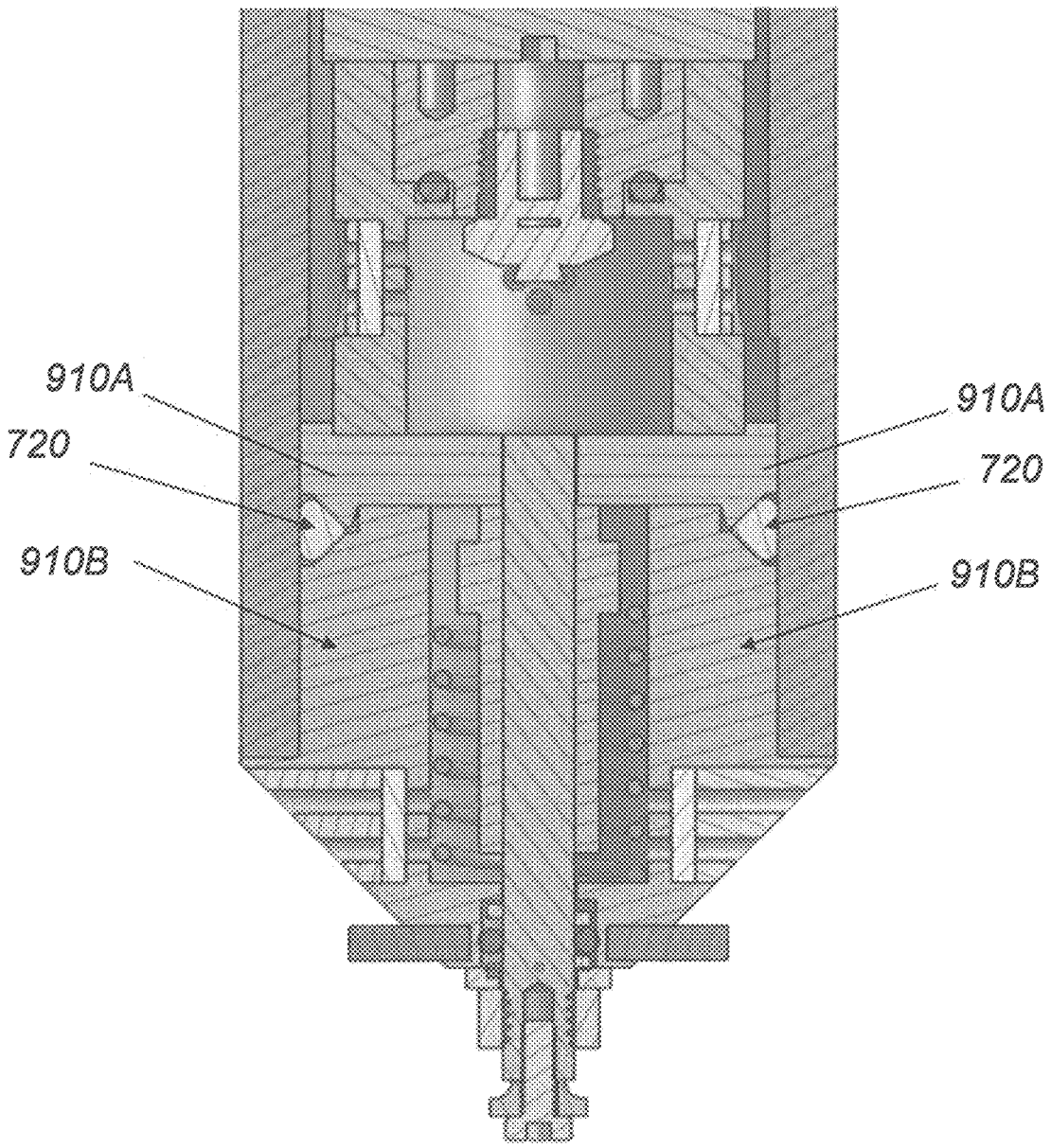
FIG. 9 is an expanded view of an additional inventive embodiment of the bottom, end cool zone of the furnace isolation chamber shown in circle in FIG. 7 with O-ring compressed.

In contrast, FIG. 9 shows the spring loaded mechanism shown in FIG. 8, with O-ring 720 compressed. In this embodiment, compression nut 730 is tightened, thereby causing top plates 910A and bottom plates 910B to approach one another resulting in O-ring 720 being in a compressed state. In the exemplary embodiment, the inclined angle of the radial outermost face of the plates, respectively, pushes the O-ring 720 outward. In this way, the plates are configured to compress and position the O-ring such that it seals against three surfaces, the two outermost faces of the plates and an interior face of chamber 110 thereby ensuring sealing on three faces. This advantageously assists the O-ring with deforming to a compressed state and minimizing the possibility of leakage and/or O-ring fatigue/failure.

Figure 10A:
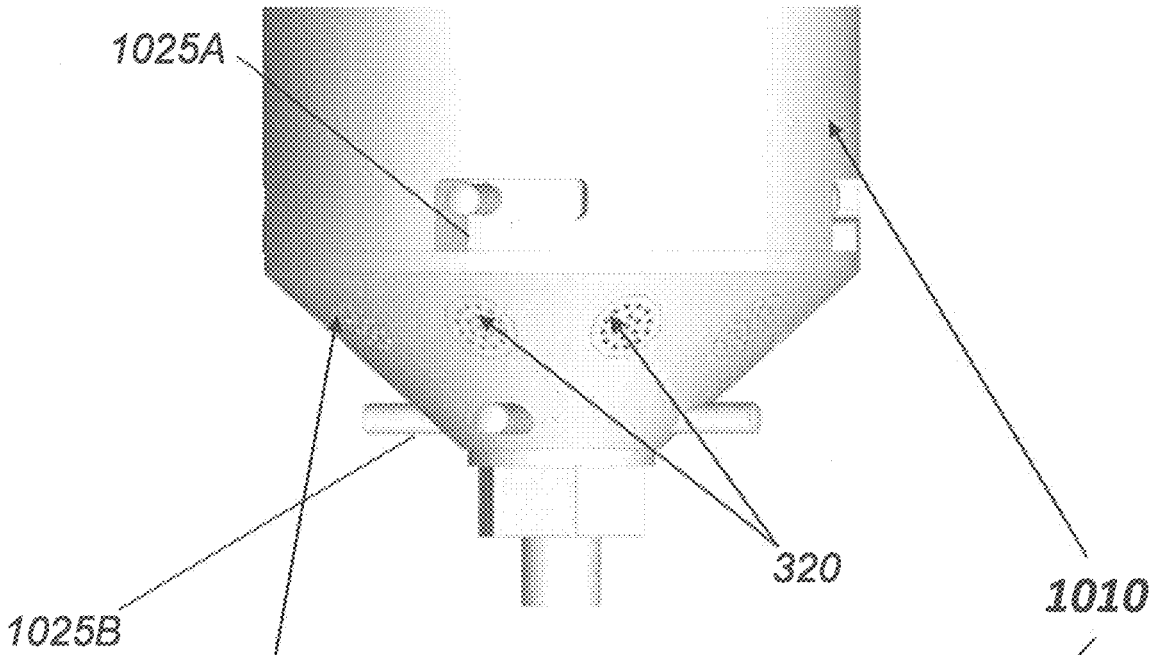
FIGS. 10A and 10B are perspective views of locking chambers and filter assemblies according to an embodiment of the present disclosure.
Figure 10B:
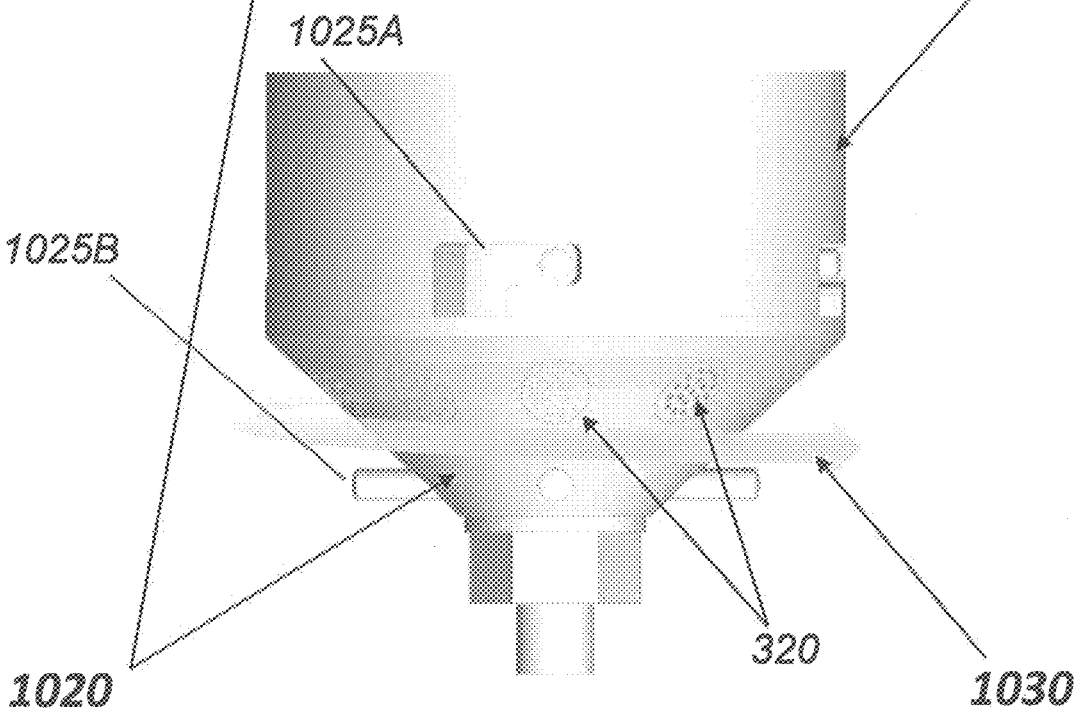

Reference is made to FIGS. 10A and 10B, which are perspective views of locking mechanisms and filter assemblies according to an exemplary embodiment of the present disclosure. The locking mechanisms and filter assemblies may work in tandem with the various embodiments disclosed throughout this disclosure and described herein for removable coupling of discrete parts. FIGS. 10A and 10B show a location of a high temperature chamber 1010 and a filter sealing assembly 1020, with the secondary filters 320. In the exemplary embodiment, the high temperature chamber 1010 is keyed to lock and unlock with filter sealing assembly 1020 by an upper limiting locking mechanism (also referred to as a twist-lock). In other embodiments, snap locks, ridges, dove-tails, and etc. may be used to removably couple filter sealing assembly 1020 to high temperature chamber 1010.

With particular reference to FIG. 10B, the upper limiting locking mechanism 1025A moves into the locked position by twisting of filter sealing assembly 1020 in direction 1030 relative to high temperature chamber 1010. In the exemplary embodiment, the upper limiting locking mechanism 1025A has a series (four) of protruded ends spaced equidistant around the upper portion of the filter sealing assembly 1020 and the the lower limiting locking mechanism 1025B has a series (four) of protruded ends spaced equidistant around the lower portion of the filter sealing assembly 1020.

Figure 11A:
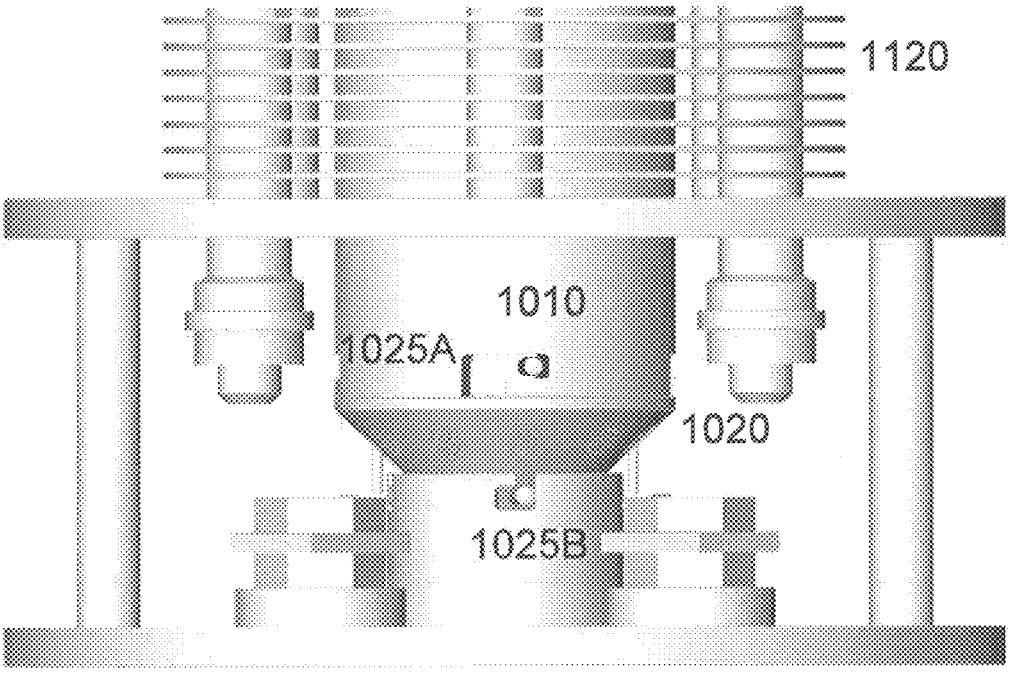
FIGS. 11A and 11B are perspective views of locking chambers and filter assemblies according to the embodiments of the present disclosure shown in FIGS. 10A and 10B respectively.
Figure 11B:
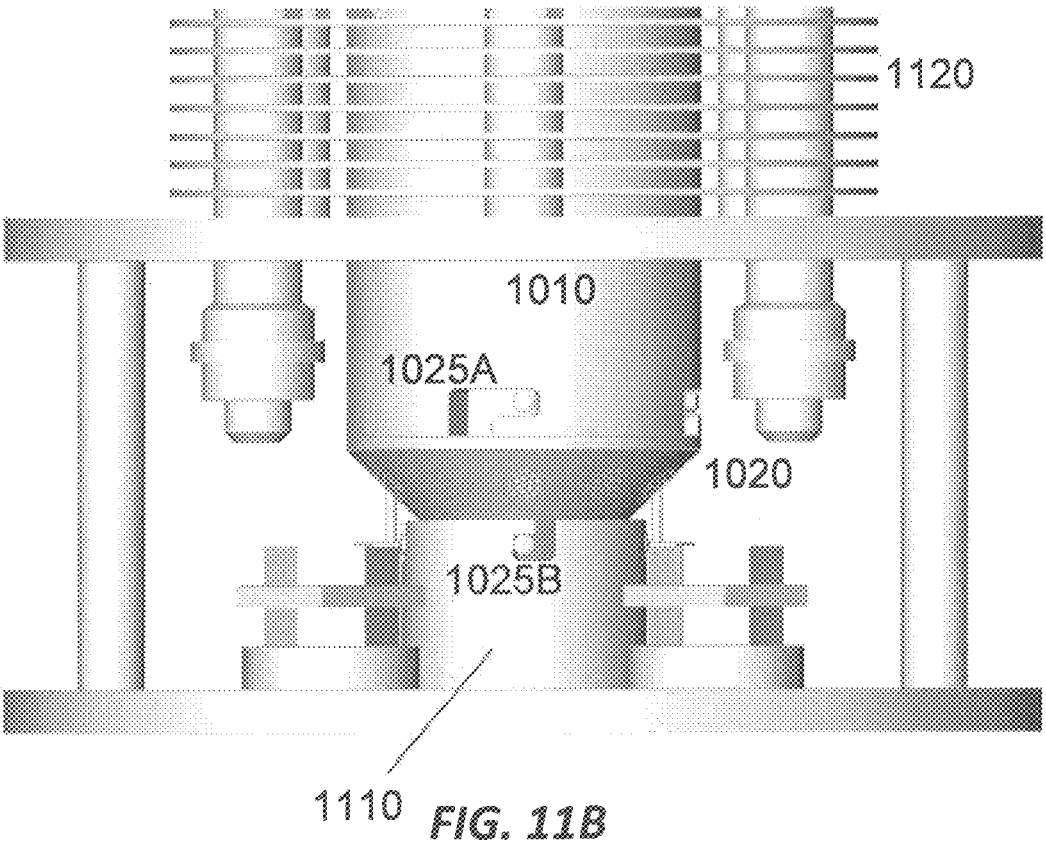

FIGS. 11A and 11B are elevation views of the embodiment of FIGS. 10A and 10B with lower limiting locking mechanism 1025B in an unlocked state (FIG. 11A) and in a locked state (FIG. 11B). With particular reference to FIG. 11B the lower limiting locking mechanism 1025B and filter sealing assembly 1020 are locked to filter support assembly 1110 by rotatable engagement. In the exemplary embodiment, the filter end support 1110 is keyed to lock and unlock with filter end support 1110 via lower limiting locking mechanism 1025B. In the exemplary embodiment, upper and lower limiting locking mechanisms 1025A, 1025B are configured to lock and unlock in opposing directions, thereby facilitating safety and ease of understanding. Filter support assembly 1110 is shown in FIGS. 10A and 10B, respectively with relation to the bottom of the AFIC system. Furthermore, cooling fins 1120 are shown.

Figures 12A, 12B:
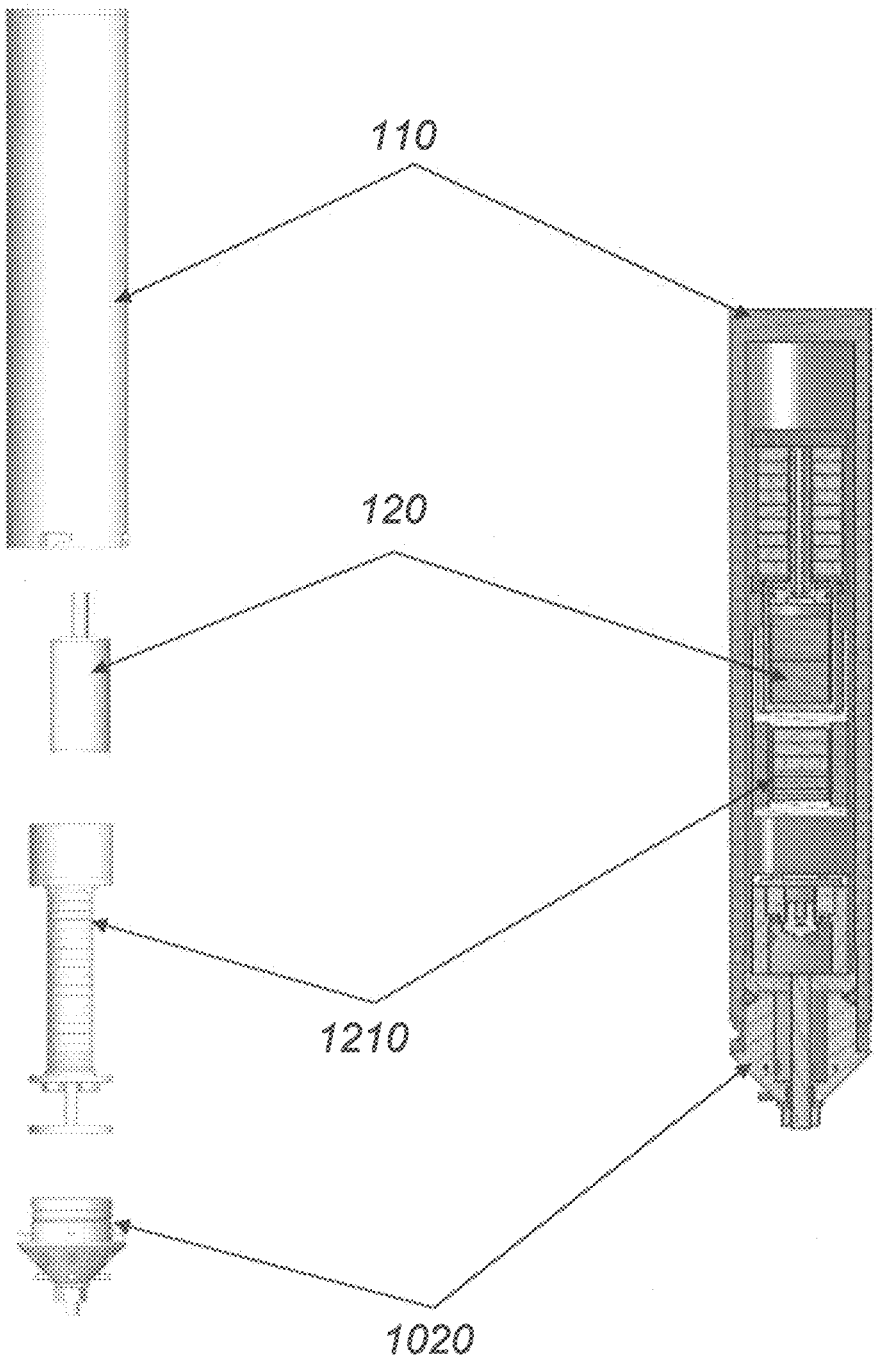
FIGS. 12A and 12B are exploded views of various aspects of an embodiment of the disclosed AFIC.

An exploded view of various aspects of an embodiment of the disclosed AFIC is provided in FIG. 12A with approximate corresponding locations of the elements of FIG. 12A shown in FIG. 12B. There is shown high temperature chamber 110, the HIP can 120, the pedestal 1210, and the filter sealing assembly 1020.

As one of skill in the art would appreciate, if the HIP can fails during processing, components within the HIP can that are volatile at the HIP processing temperatures (T>850° C.) will escape from the failed HIP can. Currently available containment systems, such as the ACOP system described earlier, have no mechanism for dealing with the escape of volatile gases. This is largely because in an ACOP system, the filters are at a same process temperature as the HIP can during use, and thus will not contain any volatile gases.

In contrast to an ACOP system, the AFIC system described herein has a thermal gradient between the high temperature zone within the furnace where HIP'ing occurs, and the much cooler zone located at the bottom of the HIP vessel and furnace. For example, in one embodiment, the temperature difference between the hot zone of the high temperature furnace and the cool zone at the bottom of the HIP vessel is at least 500° C. In other embodiments, the temperature differential is at least 750° C., or even at least 1000° C., cooler than the hot zone of the furnace. In another embodiment still, the temperature difference between the hot and cool zones is at least 1250° C. This may be accomplished, in part, by the customization of parts disclosed throughout this disclosure, for example, in FIG. 12A and the cooling fins shown in FIGS. 11A and 11B. The existence of a thermal gradient allows hot gases to escape from a failed HIP can, and the radioactive elements contained therein, to condense on the cool inside walls of the AFIC chamber prior to reaching the filters in the cool zone. As previously disclosed, the thermal gradient is a passive containment feature that is not present in an ACOP system.

Figure 13:
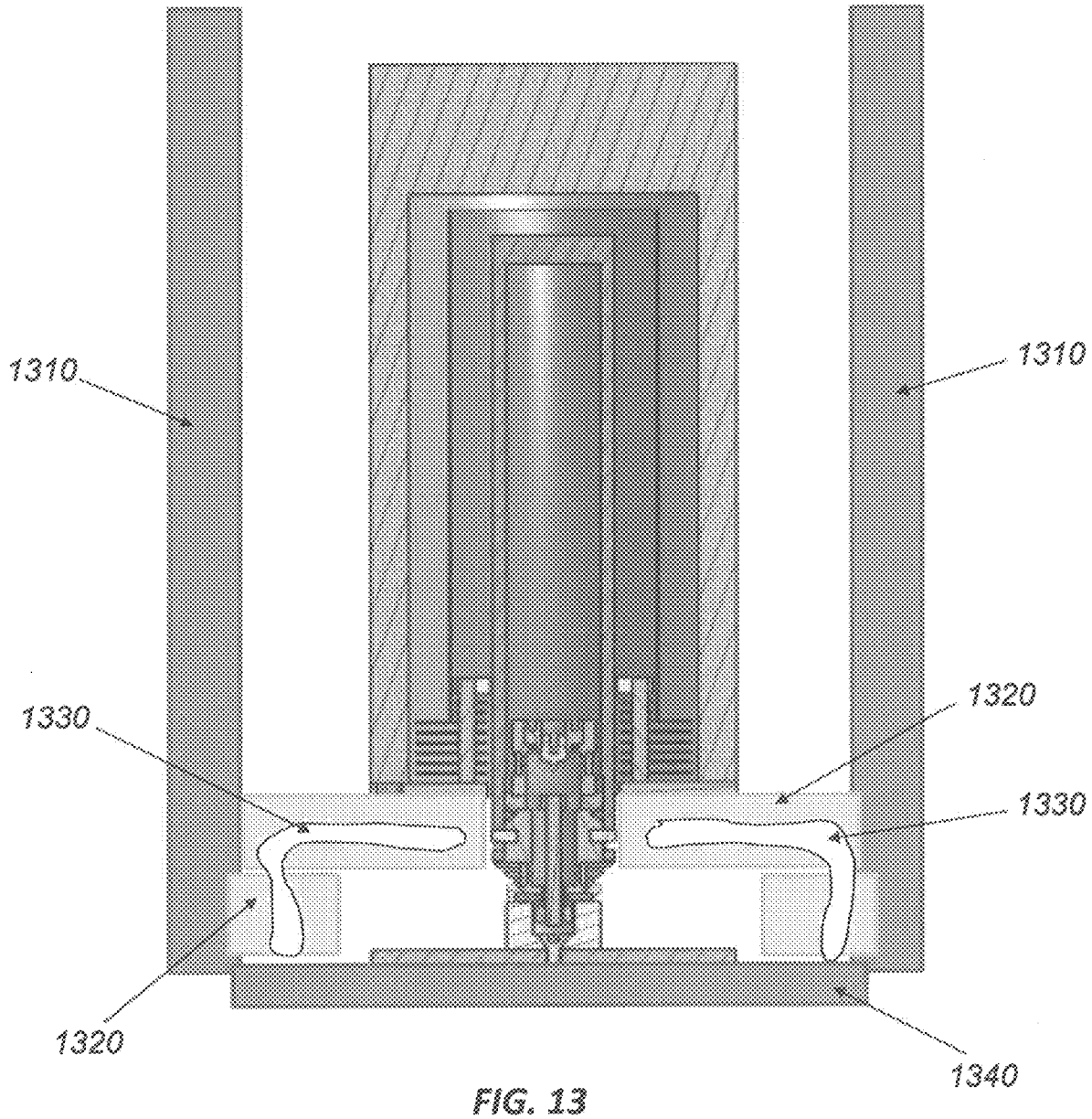
FIG. 13 is a section view of a furnace isolation chamber having a designed cooling mechanism to induce a thermal gradient cooling according to an embodiment of the present disclosure.

In addition to the passive containment feature created by the temperature gradient along the AFIC tube/chamber length from high temperature in the hot zone e.g. 1350° C. to the lower region of the AFIC tube/chamber at 50° C., it is possible to incorporate active cooling features by extending the lower portion of the AFIC to the bottom head of the HIP and including a cooling plate cooled by circulating a coolant. With regard to this embodiment, reference is made to FIG. 13, which shows a designed thermal gradient formed from a lower cooled head comprising a heat sink having a high thermally conductive material 1310. Non-limiting embodiments of such a material include aluminum, copper or alloys of such materials. These heat sinks may be made in the form of plates, blocks or fingers 1320, and may include one or more cooling channels located therein 1330 configured to directly cool the lower area of the AFIC system and cause the above mentioned temperature gradient. In this embodiment, active cooling features are incorporated into the system by having cooling plate/heat sink extending to the vessel wall 1310 and a cooled lower head 1340 where heat is transferred to the recirculating coolant for the HIP vessel.

In yet another embodiment, active cooling features are incorporated by the addition of a collar that fits around the lower part of the AFIC tube/chamber to transfer heat to an existing cooled part of the HIP vessel or an additional cooling circuit.

Although not essential, the advantage of the "forced" or "active" cooling features is that it works independent of gas pressure, as heat transfer efficiency changes as a function of the density of the gas. Active cooling may also assist in achieving the temperature gradients disclosed herein, but active cooling is not necessarily required to achieve such gradients. As disclosed herein, the chamber provides mechanical strength for expansion containment, should the can or component expand uncontrollably and protects the furnace/vessel from being mechanically damaged while the filters prevent the spread of radioactive/hazardous material contaminating the furnace, the HIP vessel, and the gas lines.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present disclosure.

Other embodiments of the invention will be apparent to those skilled in the art from consideration of the specification and practice of the invention disclosed herein. It is intended that the specification and examples be considered as exemplary only, with the true scope of the invention being indicated by the following claims.

What is claimed is:

1. A furnace isolation chamber for containing a component to be hot isostatically pressed in a hot isostatic press (HIP) system, comprising:

longitudinally cylindrical sidewalls;

a top end extending between and permanently connected to said side walls, thereby closing one end of the chamber; and a movable bottom end, which is opposite said top end and forms a base end of said chamber, said movable bottom end is adapted to receive said component, and comprises a mechanism for raising and lowering said component into a high temperature zone of the furnace in the HIP system, wherein said isolation chamber forms an integral part of the HIP system, wherein there is a temperature gradient from the top end of the furnace isolation chamber to the base end, with the base end of said chamber being located outside of the high temperature zone of the furnace.

2. The furnace isolation chamber of claim 1, wherein the portion of the chamber contained within the high temperature zone of the furnace in the HIP system contains no flanges or seal faces.

3. The furnace isolation chamber of claim 1, comprising at least one porous metal or ceramic filter.

4. The furnace isolation chamber of claim 3, wherein pressurizing gas is used in a HIP process, wherein said pressuring gas is able to act on the component to be hot isostatically pressed through the at least one porous metal or ceramic filter.

5. The furnace isolation chamber of claim 3, wherein the at least one porous metal or ceramic filter is located in the base of the chamber that is outside of the high temperature zone of the furnace.

6. The furnace isolation chamber of claim 3, wherein the at least one porous metal or ceramic filter is incorporated into at least one of the walls and a top portion of the isolation chamber or to combinations thereof.

7. The furnace isolation chamber of claim 6, wherein the at least one porous metal or ceramic filter is configured to transfer heat from the furnace via convective flow of gas there through.

8. The furnace isolation chamber of claim 1, wherein said chamber comprises at least one high temperature, high strength material comprising at least one of a metal, a ceramic, and a composite thereof.

9. The furnace isolation chamber of claim 8, wherein said metal, ceramic, and a composite thereof comprises molybdenum, tungsten, and carbon-carbon composites.

10. The furnace isolation chamber of claim 1, wherein said chamber is adapted to receive hazardous, toxic, or nuclear material.

11. The furnace isolation chamber of claim 1, wherein said component to be isostatically pressed comprises a nuclear material comprising a plutonium containing waste.

12. The furnace isolation chamber of claim 1, wherein said chamber is configured to remove particulates and provide physically clean filtered environment argon gas to materials being processed inside said chamber.

13. The furnace isolation chamber of claim 1, comprising a pressurizing gas for the HIP process comprising an inert gas chosen from Ar, and further comprising an impurity gas comprising oxygen, nitrogen, hydrocarbons, and combinations thereof.

14. The furnace isolation chamber of claim 1, wherein the temperature gradient from the top end of the furnace isolation chamber that is inside the furnace to the base end that is outside the furnace is at least 750° C., such that the base end of the furnace forms a cool zone.

15. The furnace isolation chamber of claim 14, wherein the base end of the chamber that is located outside the furnace further comprises at least device for measuring the presence of radioactivity from a radioactive containing gas that condenses on the walls of the cool zone of the chamber.

16. The furnace isolation chamber of claim 1, further comprising a pair of locking mechanisms configured to couple a filter end support to a filter sealing assembly and the filter sealing assembly to the chamber.

17. The furnace isolation chamber of claim 1, further comprising an O-ring and a pair of plates configured to compress and position the O-ring such that the O-ring makes contact with two outermost faces of the plates, respectively, and an interior face of the chamber.

18. The furnace isolation chamber of claim 1, further comprising a cooled heat sink comprising a high thermally conductive material, wherein said heat sink forms a thermal gradient within the furnace isolation chamber that causes unwanted gases to condense in or around the cooled heat sink.

19. The furnace isolation chamber of claim 18, wherein the high thermally conductive material comprises aluminum, copper or alloys of such materials.

20. The furnace isolation chamber of claim 18, wherein the cooled heat sink further comprises one or more cooling channels sufficient to recirculating coolant therethrough.

21. A method of consolidating a calcined material comprising radioactive material, said method comprising:

mixing a radionuclide containing calcine with at least one additive to form a pre-HIP powder;

loading the pre-HIP powder into a can;

sealing the can;

loading the sealed can into the furnace isolation chamber of claim 1, closing said HIP vessel; and hot-isostatic pressing the sealed can within the furnace isolation chamber of the HIP vessel.

22. The method of claim 21, wherein hot-isostatic pressing is performed at a temperature ranging from 300° C. to 1950° C. and a pressure ranging from 10 to 200 MPa for a time ranging from 10-14 hours.

23. The method of claim 18, wherein at least the loading step is performed remotely.

24. The furnace isolation chamber of claim 10, wherein said hazardous, toxic, or nuclear material is contained in a canister and said chamber is adapted to receive said canister.

* * * * *